United States Patent [19]

Annable

[11] 4,080,802

[45] Mar. 28, 1978

[54] HYBRID GAS CRYOGENIC COOLER

[75] Inventor: Richard V. Annable, Fort Wayne, Ind.

[73] Assignee: International Telephone and Telegraph Corporation, Nutley, N.J.

[21] Appl. No.: 705,219

[22] Filed: Jul. 14, 1976

[51] Int. Cl.[2] ..... F25B 19/00

[52] U.S. Cl. ..... 62/514 JT

[58] Field of Search ..... 62/335, 514 JT

[56] References Cited

U.S. PATENT DOCUMENTS

| | | | |
|---|---|---|---|
| 3,018,643 | 1/1962 | Evers | 62/514 JT |
| 3,415,077 | 12/1968 | Collins | 62/514 JT |
| 3,590,597 | 7/1971 | Campbell | 62/514 JT |
| 3,800,552 | 4/1974 | Sollami et al. | 62/514 JT |
| 3,827,252 | 8/1974 | Chovet et al. | 62/514 JT |
| 3,983,714 | 10/1976 | Fletcher | 62/514 JT |

*Primary Examiner*—Ronald C. Capossela

*Attorney, Agent, or Firm*—John T. O'Halloran; Alfred C. Hill

[57] ABSTRACT

One or more radiant cooler refrigeration stages are coupled to each other in a tandem relationship which in turn are coupled in a tandem relationship with one or more Joule-Thomson cooler stages coupled in tandem relationship with each other.

23 Claims, 1 Drawing Figure

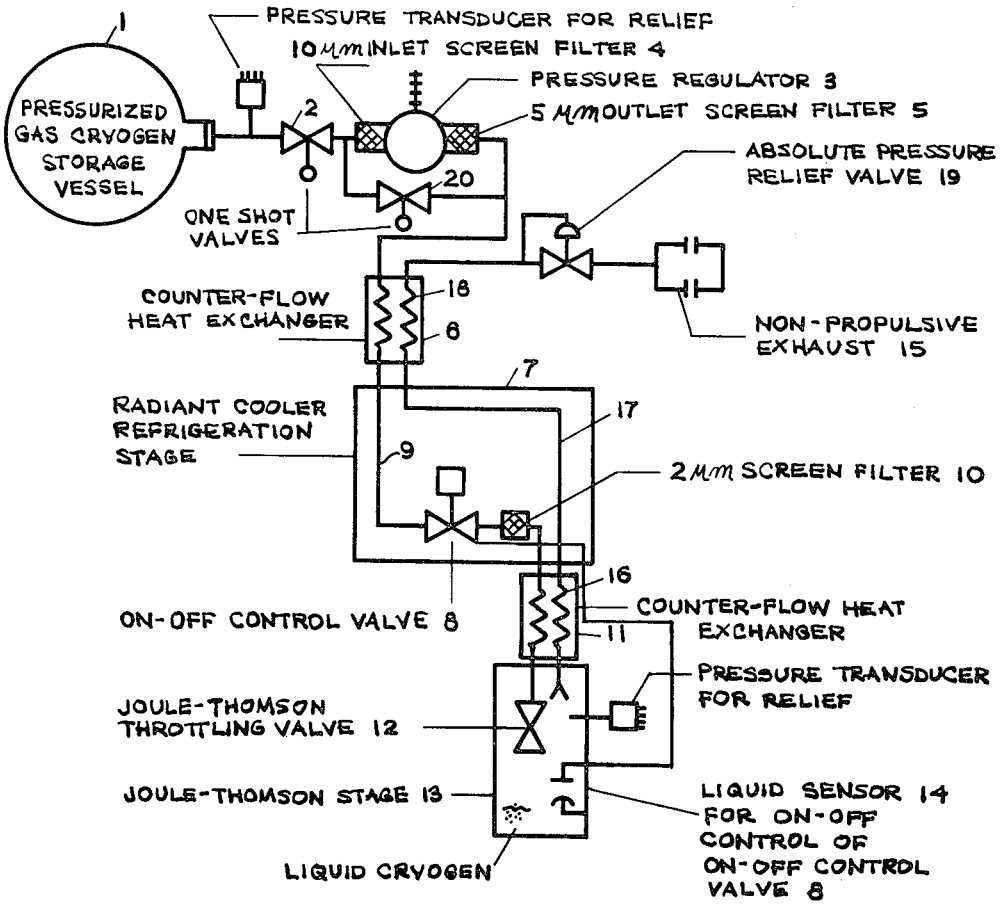

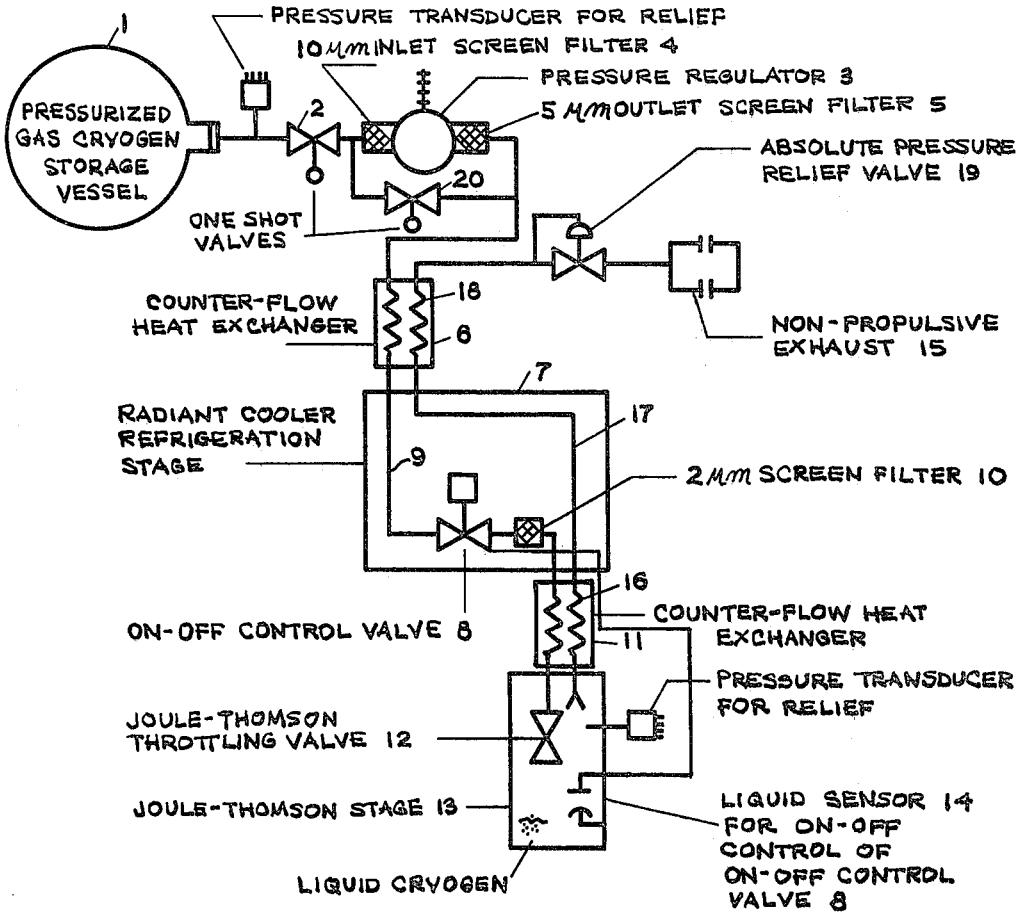
PRESSURE TRANSDUCER FOR RELIEF
10 μm INLET SCREEN FILTER 4
PRESSURE REGULATOR 3
5 μm OUTLET SCREEN FILTER 5
PRESSURIZED GAS CRYOGEN STORAGE VESSEL
1
2
20
ONE SHOT VALVES
ABSOLUTE PRESSURE RELIEF VALVE 19
COUNTER-FLOW HEAT EXCHANGER
18
6
NON-PROPULSIVE EXHAUST 15
7
RADIANT COOLER REFRIGERATION STAGE
9
17
2 μm SCREEN FILTER 10
16
COUNTER-FLOW HEAT EXCHANGER
ON-OFF CONTROL VALVE 8
11
PRESSURE TRANSDUCER FOR RELIEF
JOULE-THOMSON THROTTLING VALVE 12
JOULE-THOMSON STAGE 13
LIQUID SENSOR 14 FOR ON-OFF CONTROL OF ON-OFF CONTROL VALVE 8
LIQUID CRYOGEN

HYBRID GAS CRYOGENIC COOLER

BACKGROUND OF THE INVENTION

This invention relates to cryogenic coolers and more particularly to gas cryogenic coolers.

SUMMARY OF THE INVENTION

An object of the present invention is to provide an improved gas cryogenic cooler.

Another object of the present invention is to provide a hybrid gas cryogenic cooler.

A feature of the present invention is the provision of a hybrid gas cryogenic cooler comprising: at least a first stage including a radiant cooler refrigeration stage; and at least a second stage including Joule-Thomson cooler stage coupled to the refrigeration stage.

Another feature of the present invention is the provision of a method of cryogenic cooling comprising the steps of cooling a pressure regulated gas cryogen in at least one radiant cooler refrigeration stage; and cooling the cooled pressure regulated gas cryogen at an output of the radiant cooler refrigeration stage in at least one Joule-Thomson cooler stage.

BRIEF DESCRIPTION OF THE DRAWING

The above-mentioned and other features and objects of this invention and the manner of obtaining them will become more apparent by reference to the following description taken in conjunction with the drawing, the single FIGURE of which is a schematic diagram of a hybrid gas cryogenic cooler in accordance with the principles of the present invention.

DESCRIPTION OF THE PREFERRED EMBODIMENT

The cryogenic cooler as illustrated in the FIGURE is a hybrid gas cryogenic cooler capable of providing a cryogenic refrigerator for satellite applications. The hybrid gas cryogenic cooler illustrated utilizes the Joule-Thomson expansion of refrigerated gas. A pressurized gas cryogen in storage vessel 1 is coupled by a gas conductor through valve 2 to a pressure regulator 3. The storage vessel 1 is at ambient temperature (20° C (centigrade)). Pressure regulator 3 has a 10 mm (micrometer) inlet screen filter 4 and a 5 mm outlet screen filter 5. The pressure regulated gas from regulator 3 is transferred through a counter-flow heat exchanger 6 to a radiant cooler refrigeration stage 7 which includes therein an on-off control valve 8 coupled to the input gas conductor 9 of stage 7. Stage 7 may be a Hampson liquefier with a precooler, as described by R. B. Scott in "Cryogenic Engineering", Van Nostrand, 1959, Section 2.3. The gas is cooled in stage 7 to the temperature range from 150K to 170K, where K is equal to degrees Kelvin (the exact temperature depending on the specific design of stage 7). The refrigerated gas in stage 7 flows through valve 8 and a 2 um screen filter 10 to a second counter-flow heat exchanger 11 and is expanded through a Joule-Thomson throttling valve 12 in a low pressure region in the second stage or Joule-Thomsom stage 13 of the hybrid cooler. The expansion in valve 12 converts some of the gas into a liquid, the liquid temperature depending on the final pressure. At a certain level of the liquid cryogen a liquid sensor 14 turns off control valve 8. The remaining gas in stage 13 is exhausted through non-propulsive exhaust 15 by the gas passing through return flow gas conductor 16 of heat exchanger 11, return flow gas conductor 17 of stage 7, return flow gas conductor 18 of heat exchanger 6 and the absolute pressure relief valve 19. The exhaust is controlled by the absolute pressure relief valve 19 thereby regulating the temperature of the liquid in the second or Joule-Thomson stage 13.

The refrigeration of the gas cryogen to the 150K to 170K range prior to expansion greatly increases the fraction of the gas that is converted to liquid. The second stage 13 is in a tandem relationship with the radiantly cooled first stage 7. In actual practice, however, the second stage 13 would not only be in a tandem relationship with stage 7, but would physically surround stage 7 (except for optical ports to cooled detectors) to reduce the parasitic thermal loads. The conversion to liquid in the second stage 13 is continued until a given mass (say a gram) has been stored in the second stage 13. The heat of vaporization is then available for refrigeration. In addition, the heat capacity of the vaporized liquid is available to offset, or even eliminate, the conductive input from the first stage 7 produced by the mechanical supports and heat exchanger 11. As previously mentioned, during this time there is no incoming gas to be cooled by the exhaust gas due to turning off control valve 8 by sensor 14 and thus the throttling process in the second stage has been turned off. In addition, the radiative coupling between stages can be made very small compared with other thermal loads by means of multiple, metallic radiation shields. Under these conditions, nearly all of the heat of vaporization is available for detector associated (optical and electrical) thermal loads on second stage 13.

When the liquid cryogen in stage 13 has been vaporized down to a predetermined level, the refrigeration system is turned on again by cooperation of sensor 14 and control valve 8. As noted, control valve 8 is located at the entrance to heat exchanger 11 that leads to the Joule-Thomson throttling valve 12. When the stored liquid cryogen has reached a second predetermined level, valve 8 is again turned off by sensor 14. The gas capacity of the first stage 7 is large enough to provide the refrigerated gas necessary to produce the liquid cryogen contained between the two predetermined levels in stage 13. The duty cycle of the Joule-Thomson stage 13 is very low; a typical valve is 0.1%.

Above a certain pressure (e.g., 2700 psi (pounds per square inch) for nitrogen) the fraction of gas converted to liquid (conversion factor) does not change significantly. The use of a pressure regulator 3 set at this pressure then allows the components of the hybrid cryogenic cooler below regulator 3 to be designed for operation at the control pressure rather than at the higher maximum pressure of storage vessel 1 (e.g. 6000 psi). When the storage pressure has reached the control pressure, a one shot valve 20 is turned on to bypass regulator 3 and expand the remaining gas (down to the exhaust pressure) at a continuously decreasing conversion factor.

Heat exchanger 11 serves two distinct functions:

(A) As a conventional Joule-Thomson heat exchanger during liquid formation to transfer heat from the incoming gas stream to the outgoing gas stream in gas conductor 16.

(B) As a heat exchanger during boil-off to transfer conductive heat coming from the first stage 7 to the vent gas going back to the first stage 7.

The first or refrigeration stage 7 of cooling serves two purposes:

(A) It increases the fraction of gas converted to liquid.

(B) In combination with vent gas cooling from the cryogen boil-off, it reduces parasitic heat loads (conductive and relative) on the second stage 13 to a very low value.

The choice of the Joule-Thomson throttling 12 orifice and the operating pressure in a conventional Joule-Thomson system involves a trade-off among cool-down time, operating time, and efficiency of heat exchange. Thus, a short cool-down time calls for a large orifice and a high pressure. This increases the efficiency of heat exchange but limits the operating time.

If the cool-down time is not critical, the orifice can be made very small while the high pressure is maintained. The limit in this direction is set by plugging of the orifice by contaminants (particles and condensables).

In the case of the hybrid cooler of the present invention, the cooler is not constrained by requirements on the cool-down time. Therefore, it is possible to use in the present cooler a relatively large orifice and the higher pressure desirable for good heat exchanger efficiency and high liquid conversion factor. The Joule-Thomson portion of the hybrid cooler of the present invention operates in an intermittent or cyclic fashion and not in the continuous fashion of the conventional cryostat due to the presence of control valve 8 and sensor 14. The high flow rates during liquid production not only increase the efficiency of the heat exchanger, they also keep the duty cycle (on time of the control valve) low. This, in turn, reduces the mean power dissipation of the control valve 8. Therefore, the hybrid gas cryogenic cooler of the present invention avoids the constraints and problems associated with both the cool-down time and the plugging of a conventional Joule-Thomson system. The orifice and pressure (and therefore flow rate) can be selected on the basis of heat exchanger efficiency and liquid conversion factor (i.e., on the basis of useful refrigeration produced). The potential for plugging is further reduced by the refrigeration of the gas in the radiant cooler stage 7. This, of course, removes any condensable material prior to entering the Joule-Thomson stage 13.

The following TABLE lists the cryogens and their temperature ranges that may be employed in the hybrid gas cryogenic cooler of the present invention.

TABLE

| CRYOGENS | | |
|---|---|---|
| GASES | | TEMPERATURE RANGE (K) |
| $O_2$ | (oxygen) | 55–90 |
| $F_2$ | (fluorine) | 54–85 |
| $N_2$ | (nitrogen) | 63–77 |
| CO | (carbon monoxide) | 68–82 |
| A | (argon) | 84–87 |
| $CH_4$ | (methane) | 91–112 |
| $C_2H_4$ | (ethylene) | 104–169 |
| $CF_4$ | (carbon tetra fluoride) | 90–145 |

The following gases would be selected from the above TABLE for operation of the hybrid cryogenic cooler of the present invention between 55K to 125K. Oxygen ($O_2$) having a temperature range of 55K to 90K; methane ($CH_4$) having a temperature range of 91K to 103K and ethylene ($C_2H_4$) having a temperature range of 104K to 125K.

In accordance with the principles of the present invention, the efficiency of the hybrid cooler can be increased or its lower temperature limit reduced by the addition of a second radiant cooler refrigeration stage or a second Joule-Thomson stage, respectively.

The conversion factor is increased by a second radiant cooler refrigeration stage, that is, by adding a Joule-Thomson stage to a two-stage radiant cooler. Such a design would probably only be appropriate for a relatively large radiant cooler.

Lower temperatures can be reached by adding a second Joule-Thomson stage. If there are no detectors on the first Joule-Thomson stage, its heat load will be extremely low. Under this condition the stored gas required for the first expansion is very small and the size and weight of the storage vessel 1 are determined by the gases needed for the second exchange in the second Joule-Thomson stage.

The hybrid cryogenic cooler of the present invention has several features that make it attractive for satellite-borne applications:

(a) The cooler has a large detector refrigeration efficiency (ratio of detector associated thermal load to total thermal load).

(B) There is no stored cryogen when the cooler is not operating. The system can be launched at ambient temperature, heated for outgassing, and reheated (if necesary) for decontamination.

(c) Power consumption is very small. It is limited to the level necessary for sensing and control by sensor 14 and control valve 8; no electrical power is dissipated as part of the refrigeration process.

(d) The consumption of the refrigeration capacity (milliwatts-years) can be delayed or interrupted.

(e) Because the radiantly cooled first stage 7 operates at a relatively high temperature (150K to 170K) the design is not sensitive to the particular spacecraft and its orbit.

The refrigeration efficiency results in a lower weight cooler and reduced size. The above feature (b) eliminates the ground handling and launch logistics problems associated with stored cryogen coolers. The above feature (d) means the hybrid cooler is useful for missions with long delays or with intermittent usage (i.e., with long non-operating periods) with little or no reduction in useful operating time. Because of the last of the above feature (e) the hybrid cooler can be used on missions which do not provide the cold space view necessary for cryogenic (± 125K) passive radiant coolers.

A useful feature of the hybrid cooler of the present invention is the choice of working gas to provide an optimum refrigeration rate at selected temperatures, such as those gas cryogens (oxygen, methane and ethylene) selected from the above TABLE.

In the hybrid cooler of the present invention, nearly all (typically 92% to 98%) of the referigeration is available for detector-related thermal loads. Thus, an instrument which requires 20 milliwatts of detector-related cooling for a total operating time of one year at 65K would have a mass of about 12 kilograms (26 lbs.). On the other hand, a large detector array requiring 500 milliwatts for one year at 105K would require a cooler whose mass is about 46 kgms (100 lbs.). The hybrid cooler of the present invention can attain temperatures comparable with those in a two-stage solid cryogen cooler. On the other hand, the regfrigeration available at the higher temperatures is large compared with those in a radiant cooler.

The performance characteristics of the complete hybrid cryogenic cooler of the present invention can be determined by measurement of the following parameters. Typical values for an oxygen cryogen hybrid cryogenic cooling system are given in parentheses.

(1) Temperature and pressure of storage vessel 1 of known volume (22° C, 6000 psi).

(2) Regulated pressure to inlet of Joule-Thomson heat exchanger 11. (1500 psi).

(3) Temperatures of refrigeration, first stage, (160K) and the Joule-Thomson (second) stage (60K).

(4) Temperature differential of outlet gas from the Joule-Thomson heat exchanger 11 with respect to first stage 7 (3K.

(5) Pressure of saturated vapor above liquid cryogen in the second stage 13 (0.106 psi).

(6) Power consumption (refrigeration load) in the second stage 13 (20 milliwatts).

(7) The on time of the Joule-Thomson and the period between turn ons (8.1 seconds, 3.3 hours for production and consumption of 1 gram of liquid). Knowledge of these parameters enables comparison of the theoretical refrigeration available at the second stage 13 to the actual energy consumption over a given period. In addition, these parameters permit the monitoring of the control of the refrigeration cycle, the regulation of the second stage temperature, and the effectiveness of the Joule-Thomson heat exchanger 11.

While I have described above the principles of my invention in connection with specific apparatus it is to be clearly understood that this description is made only by way of example and not as a limitation to the scope of my invention as set forth in the objects thereof and in the accompanying claims.

I claim:

1. A hybrid gas cryogenic cooler comprising:
at least a first stage including
a pressurized gas cryogenic storage vessel,
a pressure regulator coupled to said vessel,
a first counter-flow heat exchanger coupled to said regulator, and
a radiant cooler refrigerator stage coupled to said first heat exchanger; and at least a second stage including
a Joule-Thomson cooler stage coupled to
said refrigeration stage.

2. A cooler according to claim 1, wherein
said refrigeration stage includes
an on-off control valve coupled to said Joule-Thomson cooler stage.

3. A cooler according to claim 1, wherein
said Joule-Thomson cooler stage includes
a Joule-Thomson throttling valve coupled to said refrigeration stage.

4. A cooler according to claim 1, wherein
said refrigeration stage includes
an on-off control valve controlled by said Joule-Thomson cooler stage; and
said Joule-Thomson cooler stage includes
a Joule-Thomson throttling valve coupled to said on-off control valve.

5. A cooler according to claim 4, wherein
said Joule-Thomson cooler stage includes
a liquid sensor coupled to said on-off control valve for control thereof.

6. A cooler according to claim 1, wherein
said radiant cooler refrigeration stage includes
an on-off control valve coupled to said first heat exchanger.

7. A cooler according to claim 1, wherein
said second stage further includes
a second counter-flow heat exchanger coupled between said radiant cooler refrigeration stage and said Joule-Thomson cooler stage.

8. A cooler according to claim 1, wherein
said radiant cooler refrigeration stage includes
an on-off control valve coupled to said first heat exchanger, and
said Joule-Thomson cooler stage includes
a Joule-Thomson throttling valve,
said second heat exchanger being coupled between said on-off control valve and said Joule-Thomson throttling valve.

9. A cooler according to claim 8, wherein
said Joule-Thomson cooler stage includes
a liquid sensor coupled to said on-off control valve for control thereof.

10. A cooler according to claim 9, further including
a gas cryogen exhaust,
a pressure relief valve coupled to said exhaust,
a first return flow gas conductor contained in said first heat exchanger coupled to said relief valve,
a second return flow gas conductor contained in said radiant cooler refrigeration stage coupled to said first return conductor,
a third return flow gas conductor contained in said second heat exchanger coupled between said Joule-Thomson cooler stage and said second return conductor.

11. A cooler according to claim 9, wherein
said gas cryogen is selected from the group of gas cryogens consisting of oxygen ($O_2$), fluorine ($F_2$), nitrogen ($N_2$), carbon monoxide (CO), argon (A), methane ($CH_4$), ethylene ($C_2H_4$) and carbon tetra fluoride ($CF_4$).

12. A cooler according to claim 9, wherein
said gas cryogen is selected from the group of gas cryogens consisting of oxygen ($O_2$), methane ($CH_4$) and ethylene ($C_2H_4$) to enable said hybrid cooler to operate between 55° Kelvin and 125° Kelvin.

13. A cooler according to claim 9, further including
a bypass valve connected in shunt relation with said pressure regulator, said bypass valve being activated when the pressure of said storage vessel equals a control pressure.

14. A cooler according to claim 8, further including
a gas cryogen exhaust,
a pressure relief valve coupled to said exhaust,
a first return flow gas conductor contained in said first heat exchanger coupled to said relief valve,
a second return flow gas conductor contained in said radiant cooler refrigeration stage coupled to said first return conductor,
a third return flow gas conductor contained in said second heat exchanger coupled between said Joule-Thomson cooler stage and said second return conductor.

15. A cooler according to claim 14, wherein
said gas cryogen is selected from the group of gas cryogens consisting of oxygen ($O_2$), fluorine ($F_2$), nitrogen ($N_2$), carbon monoxide (CO), argon (A), methane ($CH_4$), ethylene ($C_2H_4$) and carbon tetra fluoride ($CF_4$).

16. A cooler according to claim 14, wherein said gas cryogen is selected from the group of gas cryogens consisting of oxygen ($O_2$), methane ($CH_4$) and ethylene ($C_2H_4$) to enable said hybrid cooler to operate between 55° Kelvin and 125° Kelvin.

17. A cooler according to claim 7, wherein said gas oxygen cryogen is selected from the group of gas cryogens consisting of oxygen ($O_2$), fluorine ($F_2$), nitrogen ($N_2$), carbon monoxide (CO), argon (A), methane ($CH_4$), ethylene ($C_2H_4$) and carbon tetra fluoride ($CF_4$).

18. A cooler according to claim 7, wherein said gas cryogen is selected from the group of gas cryogens consisting of oxygen ($O_2$), methane ($CH_4$) and ethylene ($C_2H_4$) to enable said hybrid cooler to operate between 55° Kelvin and 125° Kelvin.

19. A cooler according to claim 1, wherein said gas cryogen is selected from the group of gas cryogens consisting of oxygen ($O_2$), fluorine ($F_2$), nitrogen ($N_2$), carbon monoxide (CO), argon (A), methane ($CH_4$), ethylene ($C_2H_4$) and carbon tetra fluoride ($CF_4$).

20. A cooler according to claim 1, wherein said gas cryogen is selected from the group of gas cryogens consisting of oxygen ($O_2$), methane ($CH_4$) and ethylene ($C_2H_4$) to enable said hybrid cooler to operate between 55° Kelvin and 125° Kelvin.

21. A method of cryogenic cooling comprising the steps of cooling a pressure regulated gas cryogen in at least one radiant cooler refrigeration stage; and cooling the cooled pressure regulated gas cryogen at an output of said radiant cooler refrigeration stage in at least one Joule-Thomson cooler stage.

22. A method according to claim 21, wherein said gas cryogen is selected from the group of gas cryogens consisting of oxygen ($O_2$), fluorine ($F_2$), nitrogen ($N_2$), carbon monoxide (CO), argon (A), methane ($CH_4$), ethylene ($C_2H_4$) and carbon tetra fluoride ($CF_4$).

23. A method according to claim 21, wherein said gas cryogen is selected from the group of gas cryogens consisting of oxygen ($O_2$), methane ($CH_4$) and ethylene ($C_2H_4$) to enable cooling in a temperature range between 55° Kelvin and 125° Kelvin.

* * * * *